United States Patent [19]

Harris

[11] 4,284,134

[45] Aug. 18, 1981

[54] HELICALLY COILED TUBE HEAT EXCHANGER

[75] Inventor: Arthur M. Harris, San Diego, Calif.

[73] Assignee: General Atomic Company, San Diego, Calif.

[21] Appl. No.: 939,357

[22] Filed: Sep. 5, 1978

[51] Int. Cl.[3] ..... F28D 7/10

[52] U.S. Cl. ..... 165/163; 122/32; 122/511

[58] Field of Search ..... 165/163; 122/32, 511

[56] References Cited

U.S. PATENT DOCUMENTS

| | | | |
|---|---|---|---|
| 3,130,779 | 4/1964 | Huet | 165/163 X |
| 3,882,933 | 5/1975 | Kube | 122/32 X |

*Primary Examiner*—Stephen Marcus

*Attorney, Agent, or Firm*—Fitch, Even, Tabin, Flannery & Welsh

[57] ABSTRACT

In a heat exchanger such as a steam generator for a nuclear reactor, two or more bundles of helically coiled tubes are arranged in series with the tubes in each bundle integrally continuing through the tube bundles arranged in series therewith. Pitch values for the tubing in any pair of tube bundles, taken transverse to the path of the reactor coolant flow about the tubes, are selected as a ratio of two unequal integers to permit efficient operation of each tube bundle while maintaining the various tube bundles of the heat exchanger within a compact envelope. Preferably, the helix angle and tube pitch parallel to the path of coolant flow are constant for all tubes in a single bundle so that the tubes are of approximately the same length within each bundle.

11 Claims, 3 Drawing Figures

HELICALLY COILED TUBE HEAT EXCHANGER

BACKGROUND OF THE INVENTION

The present invention relates to helical tube heat exchangers and more particularly to such heat exchangers including two or more helically coiled tube bundles arranged in series with each other. More specifically, the present invention contemplates a tube heat exchanger of the type employed as a steam generator in conjunction with a nuclear reactor.

The development of nuclear power reactors entails the efficient and economical production of electrical power from thermal energy developed in the reactor. Within this field, it is necessary to operate the reactors at temperatures sufficiently high to enable the direct production of steam at temperatures and pressures suitable for high efficiency operation of steam turbines. For this reason, high temperature nuclear reactors have been developed which, when employed with a suitable steam turbine system, provide the capability of efficiently producing large quantities of electrical power.

The high temperature reactors are commonly enclosed in a pressure vessel through which a fluid coolant such as gaseous helium or carbon dioxide is circulated to withdraw thermal energy developed by the reactor. Steam for the operation of the turbines is obtained by the transfer of heat from the coolant to the fluid of a water/steam system. Such heat transfer is conventionally accomplished in a steam generator by withdrawing thermal energy from the reactor in the form of superheated steam.

In the design of steam generators for gas-cooled reactors, it is important to minimize the resistance to the flow of heat from gas to steam/water in the overall unit while at the same time employing design measures in individual sections of the steam generator to assure operation within prudent limits for temperature, material stress and other phenomena. It is also important, however, that there be as little restriction as possible to gas flow through the steam generator in order that work expended in transporting the gas be minimized.

A number of steam generators are commonly arranged within the same containment vessel as the nuclear reactor itself. Accordingly, it is important that each steam generator be of very compact size. However, to efficiently convert water to steam within the generator and to raise its temperature and pressure to satisfactory superheated conditions, it is necessary to provide a number of heat exchanger sections within each generator. These various sections are commonly formed as different tube bundles through which a fluid to be heated and vaporized, commonly water, flows in series while the primary coolant from the reactor is circulated about the tube bundles.

Typically, a steam generator may include a series of tube bundles with different tube bundles or different portions of the tube bundles acting as an economizer section for initially heating the water, an evaporator section wherein the water is converted to steam and any number of superheated sections, The superheater sections commonly include an initial superheater section, a plurality of intermediate superheater sections and a finishing superheater to heat the steam to desired temperature levels.

These various sections within a steam generator often have very different requirements which must be met by the design of the steam generator. For example, the relative amount of heat flux for each section of the steam generator must be carefully selected in order to achieve the desired effect within that section and within the steam generator as a whole.

Under different conditions, it is necessary to vary the point along the series arrangement of tube bundles where vaporization actually takes place. This of course affects the amount of heat transfer to be accomplished within each of the tube bundles and within different portions of each tube bundle. At the same time, it is desirable to design the various tube bundles so that heat transfer and pressure drop characteristics developed within any single bundle are not dictated by the geometry of another tube bundle within the generator.

Problems such as those outlined above, together with the need for maintaining a very compact configuration in the steam generator may create pressure drop penalties or increased complexity in the design of the steam generators. This is demonstrated in the following description which is directed toward a steam generator having the further requirement of a generally constant diameter along its length. This is not an essential limitation of the present invention however.

In meeting these complexities within the prior art, it has been common practice to allow the geometry of one tube bundle to dictate that of another, e.g., transverse tube pitch is the same in both bundles, or the number of tubes is varied in different tube bundles arranged in series to achieve the necessary operating characteristics for the steam generator. In the former case, substantial penalties in steam generator size, primary coolant pressure drop or tube wall temperature and thermal stress may result. In the latter case, extra headers or tubesheets must be provided at which the tubes in question can be terminated in order to permit a change in the number of tubes.

Accordingly, there has been found to remain a need for a design of helical tube heat exchangers wherein tube bundles arranged in series are simply and efficiently designed for maximum performance both of the individual tube bundles and the entire steam generator. This problem is especially critical within steam generators employed in conjunction with nuclear reactors in accordance with the preceding discussion. However, similar problems may arise in other applications for various vapor generators. Accordingly, the present invention is directed toward any vapor generator which involves design problems of the type outlined above.

SUMMARY OF THE INVENTION

It is therefore an object of the invention to provide an improved helical tube heat exchanger of a type having two or more tubes bundles arranged in series.

It is a more specific object of the invention to provide a vapor generator with a series arrangement of tube bundles, necessarily having the same number of tubes in each tube bundle, the tubes in series related tube bundles having relative transverse pitch values which are selected as a ratio of unequal or different integers.

It is an even more specific object of the invention to provide a vapor generator as set forth above in conjunction with a nuclear reactor as a source of thermal energy.

Additional objects and advantages of the invention are made apparent in the following description having reference to the accompanying drawings.

DESCRIPTION OF THE PREFERRED EMBODIMENT

Figure 1:
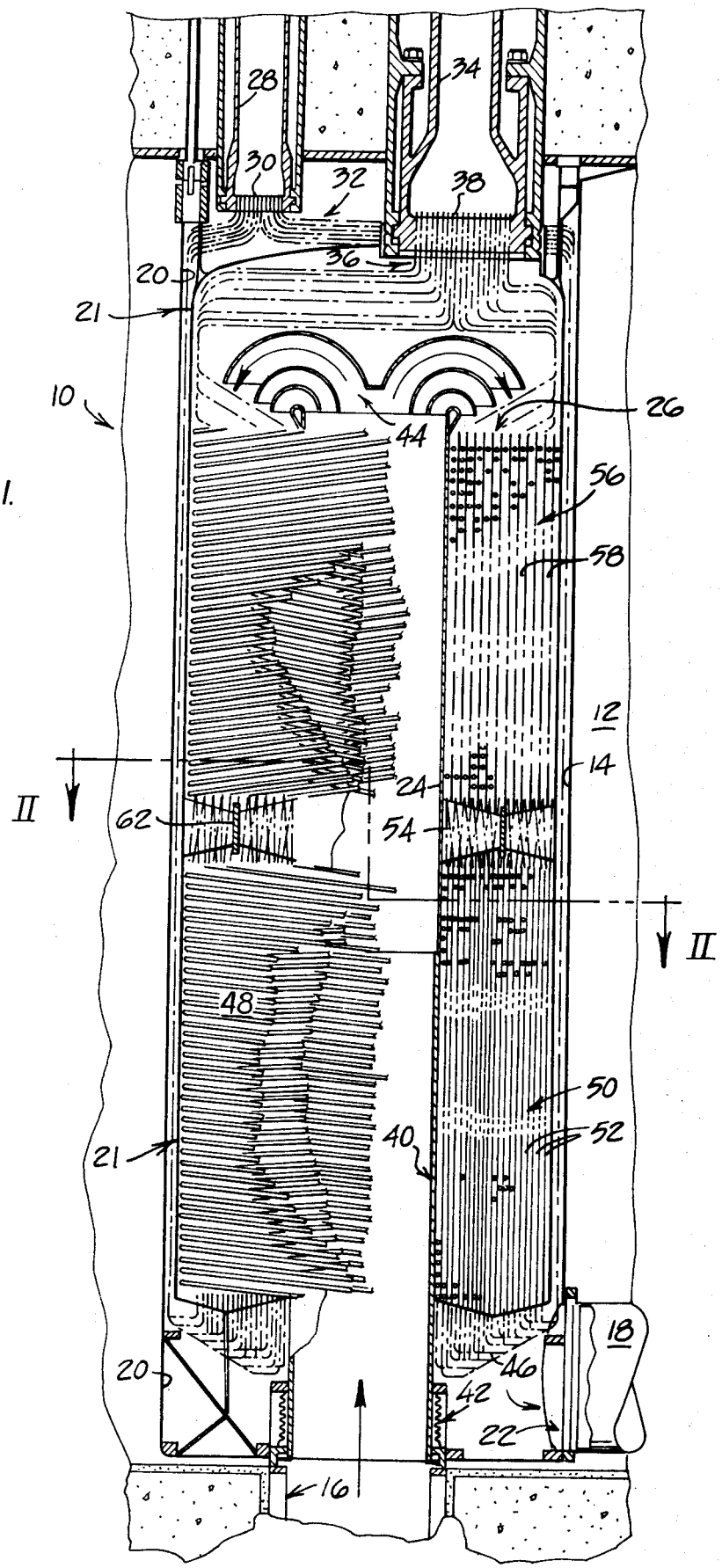
FIG. 1 is a longitudinal view with parts in section of a helical tube heat exchanger according to the present invention embodied as a steam generator in a nuclear reactor containment chamber.
Figure 3:
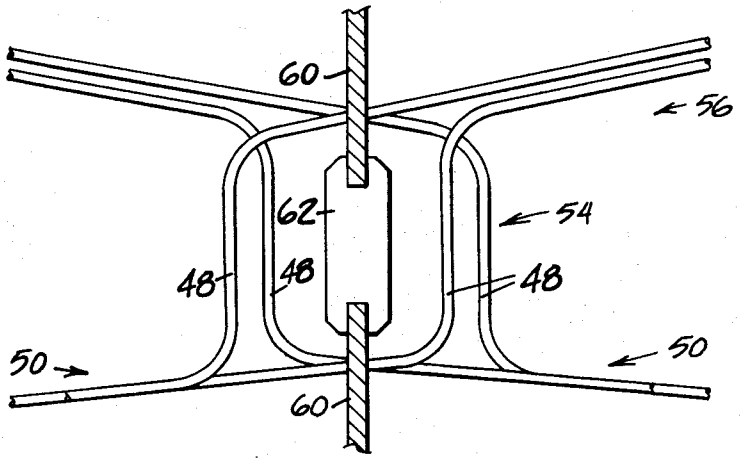
FIG. 3 is a fragmentary view of a limited portion of the transition stage taken along section lines III—III of FIG. 2.

Referring to the drawings and particularly to FIG. 1, the present invention is described below with reference to a preferred embodiment comprising a steam or vapor generator for use in a nuclear reactor, preferably a gas cooled nuclear reactor. Commonly, a plurality of steam generators is arranged within the containment vessel for a single nuclear reactor. One such steam generator is generally indicated at 10 in FIG. 1. The containment vessel for the nuclear reactor and the plurality of steam generators is commonly a prestressed concrete reactor vessel, a portion of which is indicated at 12, defining an elongated cylindrical chamber 14 for housing the steam generator 10. Alternatively, each steam generator could be housed in a cylindrical steel or concrete pressure vessel.

The nuclear reactor with which the steam generator 10 is associated is not otherwise illustrated. For purposes of the present invention, it is sufficient to understand that a primary fluid, for example helium, is circulated between the nuclear reactor and the steam generator.

Within the design contemplated for the present invention, hot primary fluid from the reactor is introduced into the bottom of the chamber 14 through an axially arranged passage 16. The primary fluid is circulated through the steam generator or heat exchanger in a manner described in greater detail below and exits through an outlet port or passage 18 by which it is returned to the nuclear reactor or any other suitable heat source.

Other geometric arrangements for leading the primary coolant into and out of the steam generator can be used. For example, hot primary coolant could enter the tube bundles at the top with primary coolant exiting at the bottom in the case of steam generators of upward boiling design or hot primary coolant could enter directly to the tube bundles at the bottom and exit at the top in the case of steam generators of downward boiling design.

Referring now specifically to the steam generator 10, its function is of course to accomplish continuing heat exchange between the primary fluid being circulated from the nuclear reactor and a secondary fluid, usually water, which is introduced into the steam generator and removed as superheated steam suitable, for example, to operate a turbine (not shown). The chamber 14 is lined with a cylindrical steel shell 20 extending upwardly from the inlet passage 16. The steam generator tube bundles and structure are enclosed in a cylindrical steel shroud or casing 21. An opening 22 is formed in the lower end of the steam generator shroud 21 for communcation with the outlet passage 18. An inlet duct 24 of smaller diameter than the shroud 21 extends upwardly from the inlet passage 16 substantially throughout the length of the chamber 14. The shroud or casing 21 and inlet duct 24 define an annular region 26 within which a plurality of tube bundles is arranged to accomplish heat exchange between the primary and secondary fluids.

Water is supplied to the steam generator through an inlet conduit 28. Feed water from the conduit 28 is communicated through a tube sheet 30 into a plurality of tubes 32 which carry the feed water to the lower end of the annular region 26. An outlet conduit 34 for receiving superheated steam from the steam generator is also arranged at the upper end of the vessel 12. Superheated steam is supplied to the outlet conduit 34 from a series of steam tubes 36 through a tube sheet 38. Alternatively, the inlet conduit 28 could be arranged at the bottom of the chamber 14.

The plurality of illustrated tube bundles arranged within the annular region 26 is designed to have primary fluid flow downwardly thereabout. Water is introduced at the lower end of the tubes and recovered from the upper ends as superheated steam. To maintain generally uniform temperatures in various portions of the lower tube bundles, insulation is arranged at 40 along the lower portion of the inlet duct 24. A seal assembly 42 at the lower end of the inlet duct 24 assures that high temperature primary fluid from the inlet passage 16 flows upwardly through the inlet duct 24 without escaping into the lower end of the annular region 26.

Multiple deflector vanes 44 are arranged at the upper end of the inlet duct 24 to turn primary fluid exiting from the duct 24 and cause it to pass downwardly through the annular region 26. The vanes 44 also serve to deflect the high temperature primary fluid away from the tube sheets 30 and 38 for the inlet water conduit 28 and the steam outlet conduit 34. However, even with the deflector vanes 44, the tube sheets 30 and 38 are located in a very high temperature region of the steam generator. Accordingly, they are formed from special metal alloys selected to withstand the high temperature environment of the steam generator and to permit continued operation over long periods of time without significant leakage.

As noted above, the tubes 32 carrying feedwater from the inlet 28 pass downwardly about the periphery of the shroud or casing 21 toward the bottom of the annular region 26. A multiplicity of leads 46 at the lower end of the annular region 26 interconnects the tubes 32 with a multiplicity of heat exchange tubes 48.

The heat exchange tubes 48 pass upwardly through the annular region 26 in a helical configuration to form a first or lower tube bundle 50. Within the lower tube bundle 50, the heat exchange tubes 48 are arranged in cylindrical shells or tiers generally indicated at 52. A lesser number of tubes is contained within each of the smaller radius cylindrical shells arranged more closely adjacent the inlet duct 24 while a greater number of tubes is contained within each of the larger diameter cylindrical shells 52 more closely adjacent the shroud or casing 21. Generally, the number of tubes per cylindrical shell is about proportional to the radius of the cylindrical shell.

At the upper end of the first tube bundle 50, each of the tubes 48 continues integrally through a transition zone 54 into a second or upper tube bundle 56. Within the second tube bundle 56, the tubes 48 are also arranged in cylindrical shells 58. However, the pitch of the tubes transverse to the axis of the generator and the number of cylindrical tiers established thereby is varied between the two tube bundles 50 and 56 in accordance with the present invention. In addition, the steam generator 10 is designed with the heat exchange tubes in the tube bundles 50 and 56 being counterwound. Accordingly, adjacent cylindrical shells of tubes are formed with opposite helical patterns or directions. The invention is of course also applicable to designs in which the direction of winding for tubes in adjacent cylindrical shells is the same.

As was noted above, the invention is designed for adaptation to a vapor generator including two or more tube bundles interconnected in series. In addition, the invention is not limited to the specific configuration of tube bundles indicated at 50 and 56. For example, the tube bundles, which are illustrated as being interconnected in series could be arranged side-by-side along the length of the heat exchanger or they could even be arranged in separate cylindrical or annular regions, one nested within the other. It would even be possible to adapt the present invention for a series arrangement of tube bundles having their axes at right angles to each other if this were allowed or dictated by design requirements for the vapor generator.

In the steam generator 10, the lower tube bundle 50 forms economizer, evaporator and initial superheater regions along its length. In accordance with conventional practice, feedwater is initially heated in the economizer section and converted to vapor or steam within the evaporator section. Superheating commences within the initial superheating region. The upper tube bundle 56 includes first and second intermediate superheater regions followed by a finishing superheater region along the length of its tubes.

Thus, the superheated steam from the upper end of the tubes 48 enters the steam tubes 36 and passes outwardly through the tube sheet 38 into the outlet steam conduit 34 for delivery to a turbine or other means adapted for steam operation.

As was noted above, the present invention is specifically directed toward the design and configuration of a plurality of tube bundles such as the lower and upper tube bundles 50 and 56. The invention is also specifically limited to such tube bundles having a helical configuration of tubes and wherein all heat exchanger tubes pass continuously through each of the series of tube bundles. Accordingly, each of the tube bundles 50 and 56 contains the same number of heat exchanger tubes 48.

Figure 2:
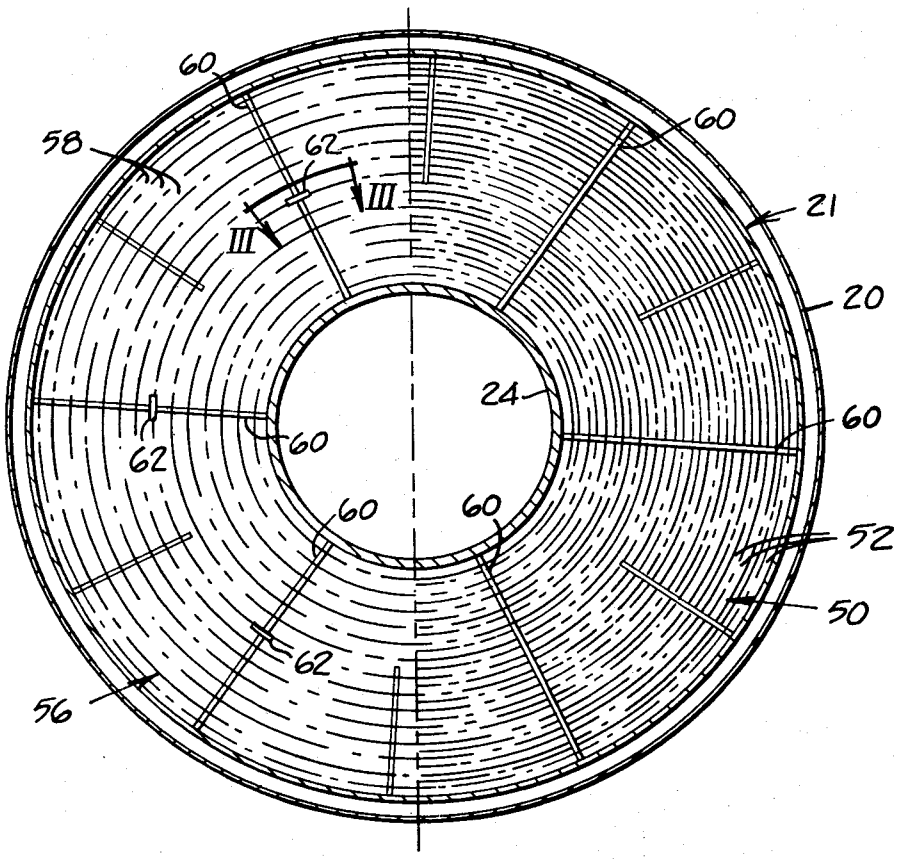
FIG. 2 is a view taken along section lines II—II in FIG. 1.

The configuration of the tubes 48 adjacent the transition zone 54 may be best seen for example in FIG. 2 in which the transverse tube spacing in the lower bundle for the design of FIG. 1 is illustrated in the right hand half of the diagram and the corresponding spacing for the upper bundle is shown at the left. A plurality of radially extending tube supports 60 and interconnecting tie plates 62 provides support for the various tubes 48. The plates 60 support the tubes 48 while the tie plates 62 have the function of guiding or supporting the upper tube bundle from the lower tube bundle plates 60. The tube supports 60 and tie plates 62 are designed to present minimum flow interference to primary fluid passing about the tubes 48. In addition, the transition zone 54 also provides an expansion joint to accommodate thermal expansion of the tubes 48. The tie plates 62 are designed to flex slightly in order to accommodate differences in thermal expansion between the upper and lower tube bundles while the tubes 48 in the transition zone are formed with bends to similarly allow for differential expansion. Although the tube support plates 60 are specifically illustrated, other forms of tube support such as "ladder" supports could also be used.

The present invention provides more space between tube cylinders for the tube support means or tube wear protection devices in the bundle having the larger transverse pitch of tubes. This can be an important factor in high temperature superheaters where allowable stresses in support structures are low.

The important pitch classification according to the present invention is that transverse to primary coolant flow which accordingly is defined by the spacing between the center lines of tubes in adjacnt cylindrical shells. Thus, the ratio of transverse pitch for adjacent tube bundles is inversely proportional to the number of cylindrical shells in the respective tube bundles. Transverse pitch of the tubes in the upper tube bundle illustrated in FIG. 1 may be twice that of the tubes in the lower tube bundle. For such a ratio, the lower tube bundle could include for example 28 tube cylinders or cylindrical shells with the upper tube bundle including 14 tube cylinders or cylndrical shells.

With pitch transverse to the direction of primary coolant flow being defined as summarized above, pitch between the tubes of each tube bundle parallel with the direction of primary coolant flow may also be selected to meet various design requirements.

The helix angles may be chosen by the designer independently of most other considerations, almost purely on the basis that the smaller the helix angles are, the shorter the unit will be so long as strength requirements are satisfied. The helix angle alone does not define the longitudinal pitch. The relationship between helix angle and longitudinal pitch for a given cylinder of tubes is $2\pi r \tan d = np$ where d is the helix angle, r is the cylinder radius, p is the longitudinal pitch and n is the number of tubes in the cylinder in question.

Whereas heat flux is primarily determined by "transverse" pitch, longitudinal pitch necessarily determines the height of each tube cylinder 52 and 58. The helix angle must be substantially increased in the upper tube bundle relative to the lower tube bundle to accommodate the larger number of tubes in each tube cylinder of the upper bundle, relative to the lower bundle.

Desired pitch is a primary limitation for establishing a compact configuration in the heat exchanger of FIG. 1 because of the design requirement that the heat exchanger 10 and accordingly the two tube bundles 50 and 56 have a constant diameter. However, if the tube bundles 50 and 56 were allowed to have different diameters, transverse pitch for the tubes in the respective bundles would not have to be related in the manner described above. A vapor generator having tube bundles of different diameters is, of course, also contemplated by the present invention. The invention also contemplates vapor generators with or without reheater sections.

Also in accordance with the present invention, relative "transverse" pitch for the tubes in the two tube bundles is not limited to the specific ratio indicated above. Depending upon contemplated operating characteristics for the heat exchanger, the ratio of "transverse" pitch for any two series connected tube bundles might have a minimum value, for example, of about four to three and a maximum variation or ratio of about five to one. The pitch could be greater in either the first or second tube bundle. Accordingly, the maximum pitch ratio could be five to one or one to five and the minimum pitch ratio four to three or three to four.

The present invention prevents the heat transfer and pressure drop characteristics for any one tube bundle, which are strongly dependent on the transverse pitch of the tubing, from being dictated by the transverse tube pitch in another bundle. In accordance with the present invention it is therefore possible, as an example, for a low heat flux superheater having relatively cool tubes to be used in a constant diameter steam generator in which high heat fluxes are used in the economizer and/or evaporator bundles or regions. This is of course the case in the steam generator 10 illustrated in FIGS. 1 and 2.

Thus, the invention has been described as contemplating a high temperature vapor generator including two or more helically coiled tube bundles, the "transverse" pitch of the tubes in the tube bundles being in the form of a ratio of two integers, each tube in one tube bundle necessarily continuing unbroken into the other tube bundle or bundles. Other variations and modifications in addition to those described and suggested above will be readily apparent in connection with the preceding description. Accordingly, the scope of the present invention is defined only by the following appended claims.

What is claimed is:

1. In a vapor generator having a housing, means for circulating a primary fluid through the housing, a plurality of helical tube bundles arranged along a flow path of primary fluid within the housing, the helically coiled bundles being interconnected in series with each other and with inlet and outlet means for circulating a secondary fluid through the tubes, the improvement comprising each of the tube bundles being arranged within the housing so that the primary fluid flows generally parallel with the axis of each tube bundle, the two tube bundles having the same number of heat exchange tubes, pitch values for the tubes in the respective tube bundles, taken transverse to the path of primary coolant flow, being selected as a ratio of two unequal integers in order to facilitate design and efficient operation of the respective tube bundles in the vapor generator.

2. The vapor generator of claim 1 wherein the vapor generator is associated with a nuclear reactor, the housing having inlet and outlet means for circulating coolant through the reactor.

3. The vapor generator of claim 1 wherein the tubes in each tube bundle are arranged in sets of cylindrical shells, each cylindrical shell including a number of tubes generally proportional to the relative diameter of the respective cylindrical shell.

4. The vapor generator of claim 3 wherein the tubes in adjacent cylindrical shells of each tube bundle are arranged with opposite helix angles to form a counterwound configuration within each of the tube bundles.

5. The vapor generator of claim 1 wherein the vapor generator housing is cylindrical, the two tube bundles being arranged in series with each other and coaxially with the vapor generator housing, the two tube bundles forming a cylindrical opening along the axis of the vapor generator housing and a cylindrical duct being arranged along the cylindrical opening, the primary coolant being caused to flow between the cylindrical housing and the centrally arranged duct for intimate heat exchange contact with the tubes in the two tube bundles.

6. The vapor generator of claim 1 wherein one of the tube bundles are arranged along a common axis, the tube bundle having greater pitch transverse to the path of primary coolant flow and also having correspondingly fewer cylinders of tubes so that the two tube bundles have generally equal outside diameters to facilitate compact design of the vapor generator.

7. A vapor generator for a nuclear reactor, the vapor generator comprising an elongated cylindrical housing, a cylindrical duct arranged along the axis of the housing to form an annular region between the duct and the housing, the housing including inlet and outlet means arranged for permitting flow of primary heat exchange fluid between the housing and the nuclear reactor and for causing the primary fluid to flow through the annular region between the central duct and housing, first and second helically coiled tube bundles arranged in the annular space between the central duct and housing, the first and second tube bundles each having a common number of heat exchange tubes interconnected in series with inlet and outlet means for causing secondary fluid to flow through the tubes in the two tube bundles, the tubes in each of the tube bundles being formed with a uniform pitch transverse to the direction of primary coolant flow, the pitch value for the respective tubes in the two tube bundles being selected substantially as a ratio of two unequal integers to facilitate design and permit efficient operation of the two tube bundles and the vapor generator.

8. The vapor generator of claim 7 wherein one of the tube bundles has greater pitch transverse of the path of primary coolant flow and also has correspondingly fewer cylinders of tubes so that the two tube bundles have generally equal outside diameters to permit a compact configuration for the vapor generator housing.

9. The vapor generator of claim 7 wherein the tubes in each tube bundle are arranged in sets of cylindrical shells, each cylindrical shell in each tube bundle including a number of tubes generally inversely proportional to the relative diameter of the respective cylindrical shell.

10. The vapor generator of claim 7 wherein the tubes in adjacent cylindrical shells of each tube bundle are arranged with opposite helix angles to form a counterwound configuration within each tube bundle.

11. The vapor generator of claim 7 wherein one of the inlet and outlet means for primary coolant is arranged in communication with one end of the central duct, the other of the inlet and outlet means being formed by a peripheral portion of the housing adjacent the one end of the central duct, turning vanes being arranged adjacent the opposite end of the central duct for promoting flow of primary coolant fluid through the two tube bundles and the central duct.

* * * * *

UNITED STATES PATENT AND TRADEMARK OFFICE

CERTIFICATE OF CORRECTION

PATENT NO. : 4,284,134

DATED : August 18, 1981

INVENTOR(S) : Arthur M. Harris

It is certified that error appears in the above—identified patent and that said Letters Patent is hereby corrected as shown below:

Column 1, line 61, "superheated" should be --superheater--.

Column 1, line 61, ", The" should be --. The--.

Column 2, line 54, "tubes" should be --tube--.

Column 5, line 4, before "tube" insert --two--.

Column 6, line 13, "adjacnt" should be --adjacent--.

Column 6, line 23, "cylndrical" should be --cylindrical--.

Column 8, line 5, after "wherein" delete --one of--.

Column 8, line 6, before "tube" insert --two--.

Column 8, line 6, after "axis" insert --one of--.

Column 8, line 7, "bundle" should be --bundles--.

Signed and Sealed this

*Fifth* Day of *January 1982*

[SEAL]

*Attest:*

GERALD J. MOSSINGHOFF

*Attesting Officer*

*Commissioner of Patents and Trademarks*